US010053118B2

(12) United States Patent
Xiang et al.

(10) Patent No.: US 10,053,118 B2
(45) Date of Patent: Aug. 21, 2018

(54) SIDEWALL STRUCTURE OF HOPPER CAR

(71) Applicant: CRRC Yangtze Corporation Limited, Wuhan (CN)

(72) Inventors: Biaowen Xiang, Wuhan (CN); Chunjiang Shi, Wuhan (CN); Wenliang Liu, Wuhan (CN); Liangcai Lin, Wuhan (CN); Bin Ling, Wuhan (CN); Huanyun Liu, Wuhan (CN); Yougang Yu, Wuhan (CN); Yueming Hu, Wuhan (CN); Yongqiang Yang, Wuhan (CN); Qun Zhang, Wuhan (CN)

(73) Assignee: CRRC YANGTZE CORPORATION LIMITED, Wuhan HB (CN)

( * ) Notice: Subject to any disclaimer, the term of this patent is extended or adjusted under 35 U.S.C. 154(b) by 0 days.

(21) Appl. No.: 14/764,706

(22) PCT Filed: Nov. 6, 2014

(86) PCT No.: PCT/CN2014/090412
§ 371 (c)(1),
(2) Date: Jul. 30, 2015

(87) PCT Pub. No.: WO2015/101104
PCT Pub. Date: Jul. 9, 2015

(65) Prior Publication Data

US 2015/0360703 A1 Dec. 17, 2015

(30) Foreign Application Priority Data

Dec. 31, 2013 (CN) ..... 2013 1 0752438

(51) Int. Cl.
*B61D 17/08* (2006.01)
*B61D 7/00* (2006.01)

(52) U.S. Cl.
CPC ..... *B61D 17/08* (2013.01); *B61D 7/00* (2013.01)

(58) Field of Classification Search
CPC . B61D 7/00; B61D 7/02; B61D 17/00; B61D 17/04; B61D 17/06; B61D 17/08
See application file for complete search history.

(56) References Cited

U.S. PATENT DOCUMENTS 4,840,127 A 6/1989 Tomaka
6,302,031 B1 * 10/2001 Smith ..... B61D 7/02 105/355

FOREIGN PATENT DOCUMENTS

CN 201659986 12/2010
CN 202935351 5/2013
(Continued)

OTHER PUBLICATIONS

International Search Report issued in PCT/CN2014/090412 dated Feb. 15, 2015.

*Primary Examiner* — Robert J McCarry, Jr.
(74) *Attorney, Agent, or Firm* — Kolisch Hartwell, P.C.

(57) ABSTRACT

The present invention discloses a sidewall structure of a hopper car, including: an integrally formed upper side beam (1), an integral sidewall panel (2), an integrally formed lower side beam (3) and a lower sidewall (4), wherein the upper side beam (1) is riveted with the integral sidewall panel (2) at the lower side; the sidewall panel (2) is riveted with the integrally formed lower side beam (3) at the lower side; the sidewall panel is of a panel-column structure in which the wall panel is integrated with a side column, and the side column is arranged at the inner side of the car body; the lower side beam (3) is riveted with the lower sidewall (4) at the lower side. According to the sidewall structure of the hopper car provided by the present invention, because of the sidewall panel with the integrally built-in side columns, the
(Continued)

strength reduction resulting from rivet holes is avoided, the increased weight and cost resulting from rivets are avoided as well, and since the side columns are built-in, the spaces between the side columns are utilized to increase the volume of the car body.

6 Claims, 4 Drawing Sheets

(56) References Cited

FOREIGN PATENT DOCUMENTS

| | | |
|---|---|---|
| CN | 103909941 | 7/2014 |
| CN | 203766779 | 8/2014 |

* cited by examiner

SIDEWALL STRUCTURE OF HOPPER CAR

FIELD OF THE INVENTION

The present invention relates to the technical field of hopper cars, and particularly relates to a sidewall structure of a hopper car.

BACKGROUND OF THE INVENTION

Side columns of a sidewall structure of a railway coal hopper car with the existing structure are arranged at the outer side of the car body, as one of the main load bearing components of the sidewall, in view of the requirements of high strength and low self weight, the side columns are of hollow rectangular tubular structures with large cross sections, and since the side columns are arranged at the outer side of the car body, spaces between the side columns are not used. In addition, the connection of the side columns and a sidewall panel is formed by riveting with rivets, because of the numerous rivets, the strength of the sidewall panel is reduced by the rivet holes on one hand, and on the other hand, coal accumulation conditions are liable to occur at the numerous rivet heads and the weight and cost of the rivets are increased as well.

SUMMARY OF THE INVENTION

The technical problem to be solved in the present invention is to provide a sidewall structure of a hopper car, which can be used for improving the space utilization rate of a car body and is convenient to connect with an underframe and an end wall.

To solve the above technical problem, the present invention provides a sidewall structure of a hopper car, including: an integrally formed upper side beam (1), an integral sidewall panel (2), an integrally formed lower side beam (3) and a lower sidewall (4), wherein the upper side beam (1) is riveted with the integral sidewall panel (2) at the lower side; the sidewall panel (2) is riveted with the integrally formed lower side beam (3) at the lower side; the sidewall panel is of a panel-column structure in which the wall panel is integrated with a side column, and the side column is arranged at the inner side of the car body; the lower side beam (3) is riveted with the lower sidewall (4) at the lower side.

Further, a winged edge (1*a*) is arranged at the lower part of the upper side beam (1); the winged edge (1*a*) is riveted with the sidewall panel (2).

Further, the upper side beam (1) is an integrally formed box-shaped beam made of an aluminum alloy material.

Further, the sidewall panel (2) includes a side plate (2*a*), side columns (2*b*) and side columns (2*c*) with triangular sections and provided with winged edges; the side columns (2*b*) with triangular sections and used for supporting and the side columns (2*c*) for conveniently riveting with a large inclined strut in the car body are equidistantly arranged at intervals at the inner side of the side plate (2*a*) close to the car body.

Further, the lower side beam (3) is an integrally formed box-shaped beam made of an aluminum alloy material, a winged edge (3*a*) riveted with the sidewall panel (2) is arranged at the upper part of the lower side beam (3), and a winged edge (3*b*) riveted with the lower sidewall (4) is arranged at the lower part of the lower side beam.

Further, the lower sidewall (4) is formed by welding a lower sidewall panel (4*a*) and a lower sidewall reinforcing plate (4*b*), and the upper part of the lower sidewall is riveted with the lower winged edge (3*b*) of the lower side beam.

According to the sidewall structure of the hopper car provided by the present invention, because of the sidewall panel with the integrally built-in side columns, the strength reduction resulting from rivet holes is avoided, the increased weight and cost resulting from rivets are avoided as well, since the side columns are built-in, the spaces between the side columns are utilized to increase the volume of the car body, the assembly procedures of the side columns and the wall panels are omitted, the integral structure of the car body is relatively simplified, the car body is convenient to assemble in a modularized manner, and the assembly manufacturability of the car body is improved.

DETAILED DESCRIPTION OF THE EMBODIMENTS

Figure 1:
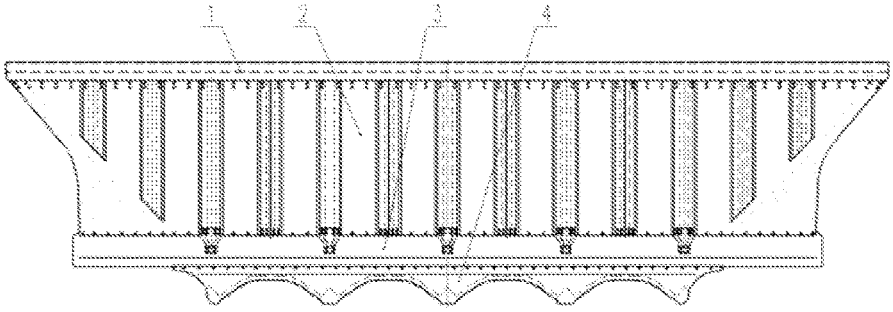
FIG. 1 is a front view of a sidewall structure of a hopper car provided by an embodiment of the present invention.
Figure 2:
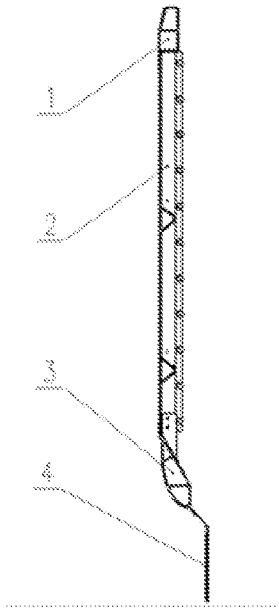
FIG. 2 is a schematic diagram of a lateral structure of a sidewall structure of a railway coal hopper car provided by an embodiment of the present invention.
Figure 3:
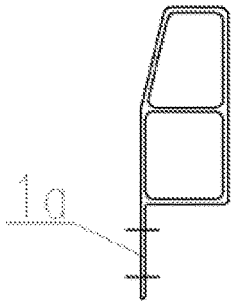
FIG. 3 is a schematic diagram of a structure of an upper side beam of a sidewall structure of a railway coal hopper car provided by an embodiment of the present invention.
Figure 4:
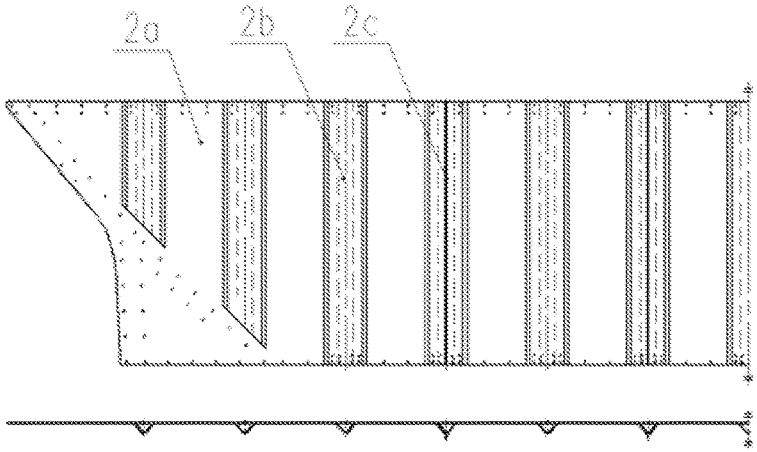
FIG. 4 is a schematic diagram of a structure of a sidewall panel of a sidewall structure of a railway coal hopper car provided by an embodiment of the present invention.
Figure 5:
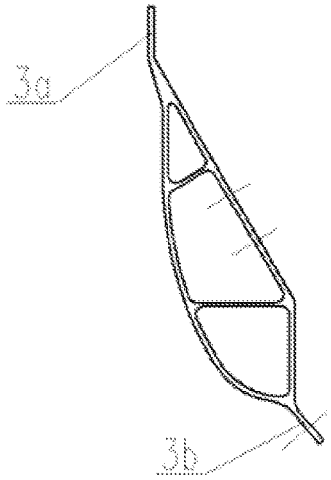
FIG. 5 is a schematic diagram of a structure of a lower side beam of a sidewall structure of a railway coal hopper car provided by an embodiment of the present invention.
Figure 6:
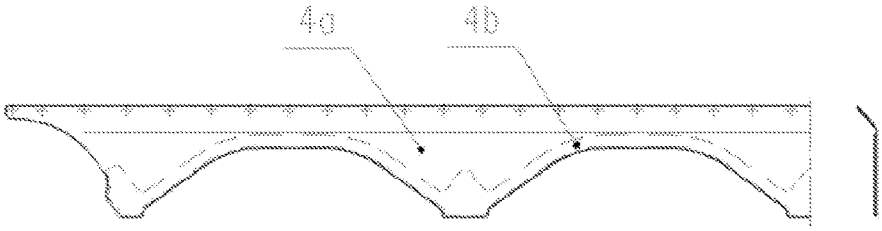
FIG. 6 is a schematic diagram of a structure of a lower sidewall of a sidewall structure of a railway coal hopper car provided by an embodiment of the present invention.
Figure 7:
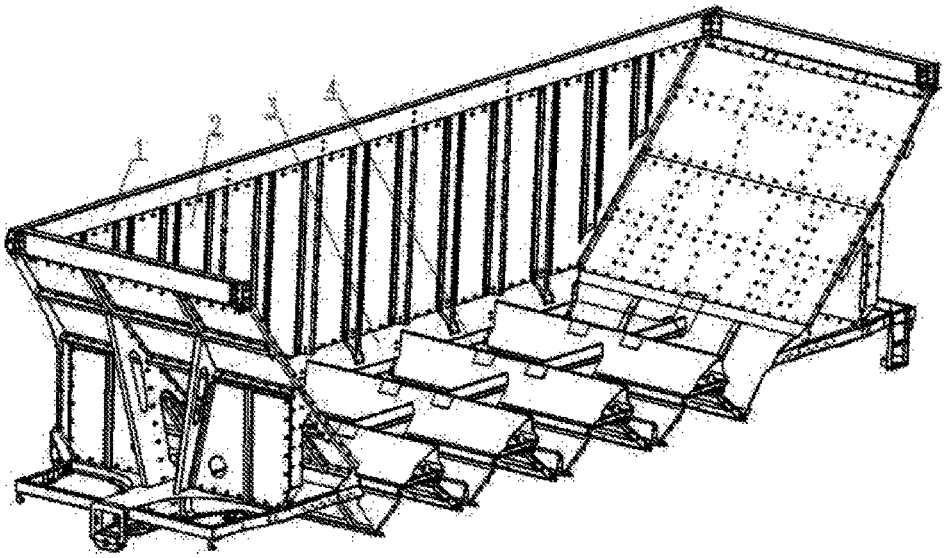
FIG. 7 is a schematic diagram of connection of a sidewall structure of a railway coal hopper car and an underframe assembly provided by an embodiment of the present invention.

As shown in FIG. 1 to FIG. 7, a sidewall structure of a railway coal hopper car provided by an embodiment of the present invention includes: an integrally formed upper side beam 1, an integral sidewall panel 2, an integrally formed lower side beam 3 and a lower sidewall 4, wherein the upper side beam 1 is riveted with the integral sidewall panel 2 at the lower side; the sidewall panel 2 is riveted with the integrally formed lower side beam 3 at the lower side; the sidewall panel is of a panel-column structure in which the wall panel is integrated with a side column, and the side column is arranged at the inner side of the car body; the lower side beam 3 is riveted with the lower sidewall 4 at the lower side.

A winged edge 1*a* is arranged at the lower part of the upper side beam 1; the winged edge 1*a* is riveted with the sidewall panel 2. The upper side beam 1 is an integrally formed box-shaped beam made of an aluminum alloy material. The sidewall panel 2 includes a side plate 2*a*, side columns 2*b* and side columns 2*c* with triangular sections and provided with winged edges. The side columns 2*b* with triangular sections and used for supporting and the side columns 2*c* for conveniently riveting with a large inclined strut in the car body are equidistantly arranged at intervals at the inner side of the side plate 2*a* close to the car body. In addition, the triangular sections of the side columns 2*b* and the side columns 2*c* have the same size, thus a mold can be shared to simplify the production process.

The lower side beam 3 is an integrally formed box-shaped beam made of an aluminum alloy material, a winged edge 3*a* riveted with the sidewall panel 2 is arranged at the upper part of the lower side beam 3, and a winged edge 3*b* riveted with the lower sidewall 4 is arranged at the lower part of the lower side beam. The lower side beam is integrally formed by the aluminum alloy material, so that the structure is light and compact, the limit can be utilized to the maximum, the appearance is beautiful and the strength is good.

The lower sidewall 4 is formed by welding a lower sidewall panel 4*a* and a lower sidewall reinforcing plate 4*b*, and the upper part of the lower sidewall is riveted with the lower winged edge 3*b* of the lower side beam.

According to the sidewall structure of the hopper car provided by the present invention, because of the sidewall panel with the integrally built-in side columns, the strength reduction resulting from rivet holes is avoided (as the number of the rivets is greatly decreased, the negative effect of the rivet holes on the strength is greatly weakened), the increased weight and cost resulting from rivets are avoided as well, since the side columns are built-in, the spaces between the side columns are utilized to increase the volume of the car body, the assembly procedures of the side columns and the wall panels are omitted, the integral structure of the car body is relatively simplified, the car body is convenient to assemble in a modularized manner, and the assembly manufacturability of the car body is improved.

Finally, it should be noted that the above-mentioned implementations are merely used for illustrating the technical solutions of the present invention, rather than limiting; although the present invention has been described in detail with reference to the foregoing embodiments, those of ordinary skill in the art should understand that modifications or equivalent substitutions can be made to the technical solutions of the present invention without departing from the spirit and scope of the technical solutions of the present invention, and these modifications or equivalent substitutions shall fall within the scope of the claims of the present invention.

The invention claimed is:

1. A sidewall structure of a hopper car, comprising: an integrally formed upper side beam (1), an integral sidewall panel (2), an integrally formed lower side beam (3) and a lower sidewall (4), wherein the upper side beam (1) is riveted with the integral sidewall panel (2) at the lower side; the sidewall panel (2) is riveted with the integrally formed lower side beam (3) at the lower side; the sidewall panel is of a panel-column structure in which the wall panel is integrated with a side column without requiring an assembly of the side column and the wall panel, and the side column runs from the upper side beam to the lower side beam and is arranged at the inner side of a car body; the lower side beam (3) is riveted with the lower sidewall (4) at the lower side.

2. The sidewall structure of the hopper car of claim 1, wherein a winged edge (1*a*) is arranged at the lower part of the upper side beam (1); the winged edge (1*a*) is riveted with the sidewall panel (2).

3. The sidewall structure of the railway coal hopper car of claim 1, wherein the upper side beam (1) is an integrally formed box-shaped beam made of an aluminum alloy material.

4. The sidewall structure of the hopper car of claim 1, wherein the sidewall panel (2) comprises a side plate (2*a*), side columns (2*b*) and side columns (2*c*) with triangular sections and provided with winged edges; the side columns (2*b*) with triangular sections and used for supporting and the side columns (2*c*) for conveniently riveting with a large inclined strut in the car body are equidistantly arranged at intervals at the inner side of the side plate (2*a*) close to the car body.

5. The sidewall structure of the hopper car of claim 1, wherein the lower side beam (3) is an integrally formed box-shaped beam made of an aluminum alloy material, a winged edge (3*a*) riveted with the sidewall panel (2) is arranged at the upper part of the lower side beam (3), and a winged edge (3*b*) riveted with the lower sidewall (4) is arranged at the lower part of the lower side beam.

6. The sidewall structure of the hopper car of claim 5, wherein the lower sidewall (4) is formed by welding a lower sidewall panel (4*a*) and a lower sidewall reinforcing plate (4*b*), and the upper part of the lower sidewall is riveted with the lower winged edge (3*b*) of the lower side beam.

* * * * *